United States Patent [19]

Böhme et al.

[11] Patent Number: 4,559,664

[45] Date of Patent: Dec. 24, 1985

[54] AUTOMATIC WASHING- AND RINSING DEVICE FOR TITRATION PLATES OR THE LIKE

[75] Inventors: Eike Böhme; Peter Rubenzer, both of Salzburg, Austria

[73] Assignee: Prolic AG, Zug, Switzerland

[21] Appl. No.: 493,136

[22] PCT Filed: Aug. 30, 1982

[86] PCT No.: PCT/AT82/00025

§ 371 Date: Apr. 29, 1983

§ 102(e) Date: Apr. 29, 1983

[87] PCT Pub. No.: WO83/00819

PCT Pub. Date: Mar. 17, 1983

[51] Int. Cl.[4] ..... B67C 1/06

[52] U.S. Cl. ..... 15/302; 15/304; 134/171

[58] Field of Search ..... 15/302, 304; 134/166 R, 134/169 R, 171, 94

[56] References Cited

U.S. PATENT DOCUMENTS

| | | | |
|---|---|---|---|
| 2,814,575 | 11/1957 | Lange | 15/302 X |
| 3,448,743 | 6/1969 | Berry | 134/171 X |
| 3,533,744 | 10/1970 | Unger | 23/230 |
| 3,856,572 | 12/1974 | Hildebrand | 134/96 |
| 3,922,750 | 12/1975 | Cioni et al. | 134/171 X |
| 3,949,771 | 4/1976 | Dodge et al. | 15/322 X |
| 4,341,568 | 7/1982 | Christensen | 15/302 X |

FOREIGN PATENT DOCUMENTS

| | | |
|---|---|---|
| 2731994 | 1/1978 | Fed. Rep. of Germany . |
| 2277630 | 2/1978 | France . |

*Primary Examiner*—Chris K. Moore

*Attorney, Agent, or Firm*—Wenderoth, Lind & Ponack

[57] ABSTRACT

An apparatus for washing and rinsing a titration plate having a plurality of cavities includes a treatment station for supporting and retaining a titration plate to be washed and rinsed. A washing plate has a lower surface and is positioned above the treatment station. A titration plate to be washed and rinsed is supplied to the treatment station below the washing plate, with the cavities of the titration plate directed upwardly. The lower surface of the washing plate and the upper surface of the titration plate are brought into sealing contact. A plurality of nozzles are at the lower surface of the washing plate and extend into respective cavities of the titration plate. The washing plate has formed therein a plurality of bores surrounding respective nozzles, thereby defining respective annular gaps. At least one discharge channel is formed in the washing plate and is connected to the annular gaps. A liquid or gas is supplied under pressure through the washing plate and the nozzles into the cavities, and the liquid or gas then is driven under pressure through the annular gaps and is discharged.

9 Claims, 10 Drawing Figures

AUTOMATIC WASHING- AND RINSING DEVICE FOR TITRATION PLATES OR THE LIKE

FIELD OF THE INVENTION

The present invention relates to a washing and rinsing device for titration plates or the like having a multitude of cavities to receive a medium to be examined or to be determined, e.g. antigens, the device being of the type having feeding means with nozzles feeding a rinsing liquid into each cavity, suction and/or blow-out means to discharge liquid from the cavities, and guide means for moving the titration plate to the washing location and retaining it in a precise position thereat.

CHARACTERISTICS OF THE STATE OF THE ART

In medical laboratories, the Elisa technique (enzyme linked immunosorbent assay) and various methods of this type are employed, for example, for measuring antigens and/or antibodies. When measuring antigens, for example, antibodies are absorbed at the titration plate in a first method step, subsequently the titration plate is washed, then in a further step a residual solution which contains the antigen is admixed, then washing follows again, whereupon enzyme-marked specific antibodies are placed on the titration plate, then the titration plate is washed again, whereupon the enzyme substrate is admixed.

The actual measuring is effected in a photometer.

As can be seen from the afore-described example, washing of the titration plate is an essential component of such method and is, on the one hand, relatively time-consuming and has, on the other hand, the further disadvantage that often highly poisonous, i.e. highly pathogenic, living substance has to be handled, which makes manual handling of the titration plates undesirable.

However, the essential problem arising when washing the titration plates is the following:

The titration plates presently in use have 96 cavities, each of them substantially corresponding to a vessel. During the known method, when identifying and determining the antigens or antibodies, there are specimens in each cavity (e.g. specimens from various patients). It must be positively prevented that, when handling the plate, parts of the specimens pass from one cavity into another, and this is particularly difficult to prevent during washing.

OBJECT OF THE INVENTION

It is, therefore, the object of the invention to provide a washing and rinsing device of the above-mentioned type, by means of which titration plates can be washed in a failsafe manner and which prevents the occurrence of parts of specimens passing from one cavity into another one and thus obviates altogether any contamination of the specimens.

SUMMARY OF THE INVENTION

According to the invention, this object is achieved by the provision of a washing plate provided with nozzles and to which the titration plate to be rinsed is, by means of guide means, movable into sealing contact and at which the titration plate is held through pressure during a washing and rinsing operation. A nozzle and an annular gap connecting the cavity with a discharge channel is associated with each cavity of the titration plate, and each individual cavity is sealed with respect to the other cavities.

The above-described method is only an example of the environments in which the automatic device of the invention is employable. Similar methods and similar determinations are also required in agriculture and in biology and biochemistry. Furthermore, the term "titration plate" is not to be taken in a limited sense, and is intended to encompass any plate having a multitude of adjacently arranged cavities which have to be washed simultaneously. There could naturally be a row of cavities in a single plate, or individual vessels could also be held in a support frame and, thus arranged, by fed to the automatic washing and rinsing device.

In the basic version, tap water is used as the washing and rinsing liquid for the automatic rinsing device according to the invention, and compressed air serves as a drying medium. In the device according to the invention it may, however, be provided that other liquids, e.g. distilled water or a buffer solution, are used, and other gaseous mediums, e.g. oxygen, are used instead of compressed air.

It is preferably provided that the gaseous medium is passed through the nozzles with pulsating movements, thus substantially improving the cleaning and drying effect.

An embodiment of the invention provides that the washing plate is disposed in a tight washing chamber. A sensor may be arranged in the washing chamber for controlling the seal between the washing plate and the titration plate and possibly for initiating a pre-programmed self-cleaning process for the washing plate, if leakage has been detected, so that contamination of following titration plates is prevented.

Such self-cleaning may, however, also be effected automatically as a precaution after the passage of a predetermined number of titration plates to be cleaned. This may be done by means of cleaning nozzles positioned opposite to the side of the washing plate provided with nozzles. Means may also be provided, however, for lifting the washing plate from the titration plate (or vice versa), whereby after the passage of liquid through the nozzles, further liquid is passed through the nozzles of the washing plate when the washing plate is in the lifted-up position. Because of the small distance between the washing plate and the titration plate, the surface of the washing plate and of the titration plate are cleaned if the rinsing medium has the necessary pressure.

The automatic washing and rinsing device according to the invention is advantageously provided with guide means holding the titration plates with clearance at a base, i.e. the titration plate is guided along its sides and lower side edges, so that the bottom side of the plate is not contaminated. This is of importance for subsequent measuring of specimens.

A further embodiment of the invention provides a tilting means for the titration plates, preferably in the washing region. The titration plate can be tiltable together with the washing plate. It is an advantage of this embodiment that the rinsing liquid can run off at the lower side and that a separate drying process by means of compressed air is not required.

BRIEF DESCRIPTION OF THE DRAWINGS

In the following the invention is described in detail with reference to the attached drawings, without limiting the invention of the illustrated embodiments, as variants of such embodiments are conceivable and possible without departing from the scope of the invention. In the drawings.

DESCRIPTION OF PREFERRED EMBODIMENTS

Figure 1:
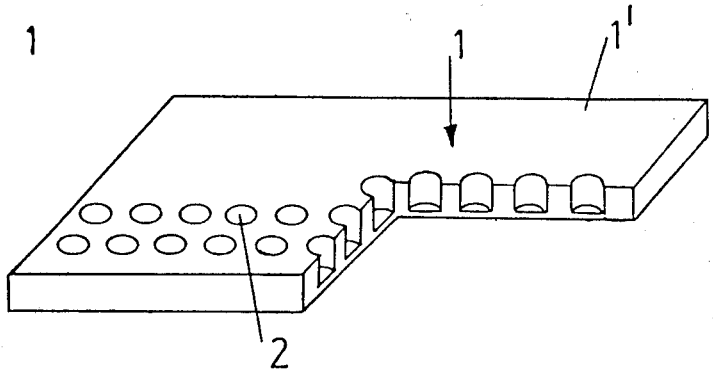
FIG. 1 is a perspective view, partially broken away, of a titration plate to be cleaned, but showing only a portion of the cavities therein.

FIG. 1 shows a titration plate 1 with cavities 2. Such titration plates 1 which are presently in use generally have eight rows of twelve cavities 2 each, which makes a total of ninety-six cavities, although the arrangement illustrated in the drawings provides for sixty cavities.

The automatic washing and rinsing device according to the invention includes unstacking means 3, a treatment or washing position or station 6 and stacking means 4.

Figure 2:
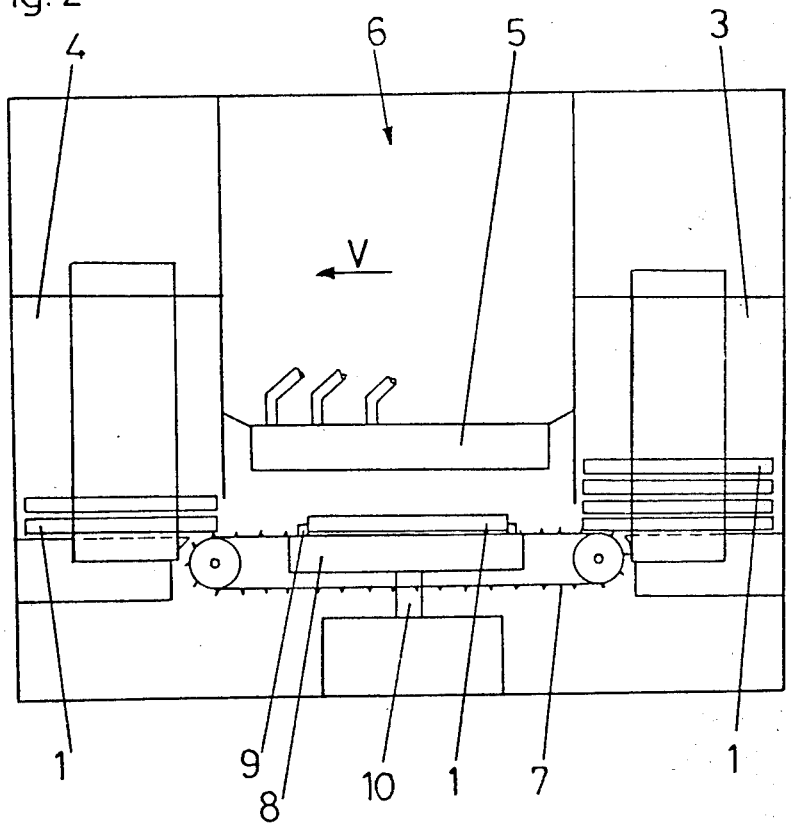
FIG. 2 is a schematic view of an automatic washing and rinsing device according to the invention.

The titration plates 1 to be washed and rinsed are, for example, placed onto the unstacking means 3 in a stack of ten pieces. Then the plates are individually moved by conveying means with toothed belts 7 in the direction of arrow V in FIG. 2 to the washing position 6 below a washing plate 5. After being rinsed, the plates are placed onto the stacking means 4.

Below the washing plate 5 each titration plate is positioned on a support plate 8 provided with centering means 9, e.g. centering bolts, for the exact positioning of the titration plate 1 at station 6 in a predetermined orientation.

When the titration plate 1 is in its desired position, the support plate 8 is lifted by lifting means 10, e.g. a pneumatic cylinder, and the titration plate 1 thereby is against the washing plate 5.

Figure 3A:
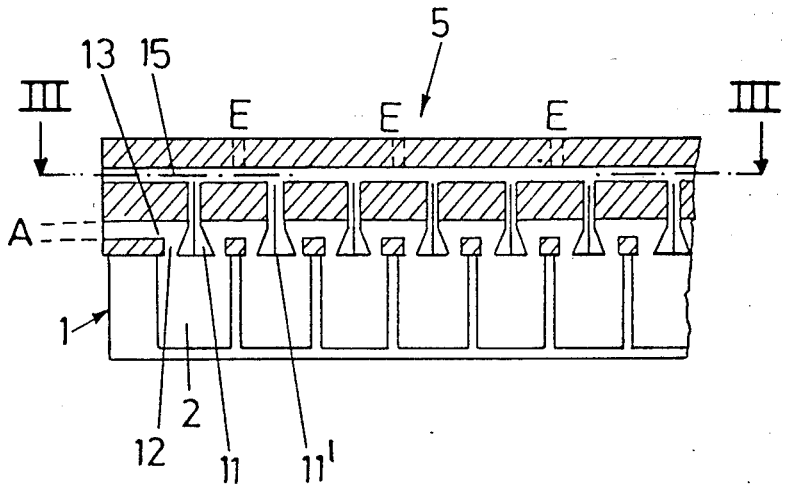
FIG. 3*a* is a section along line III*a*—III*a* of FIG. 3, but also showing the upper portion of the device and a titration plate.
Figure 3:
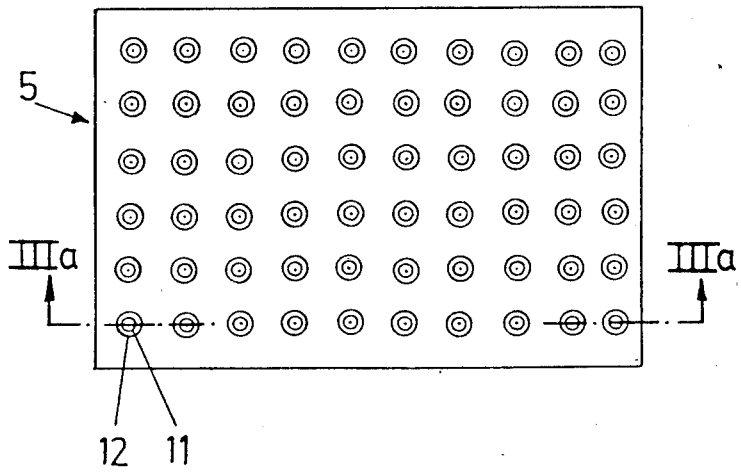
FIG. 3 is a top view of a washing plate according to the invention, taken along line III—III in FIG. 3*a*.

As can particularly be seen from FIGS. 3 and 3*a*, the washing plate 5 has a multitude of nozzles 11, the number and positions of which correspond exactly to the number and positions of the cavities 2 in the titration plate 1. In the embodiment illustrated in FIG. 3, the washing plate 5 has sixth nozzles 11. When the titration plate 1 is pressed against the washing plate 5, as can be seen from FIG. 3*a*, each nozzle 11 is associated with a respective cavity 2.

An annular gap 12 is arranged around each nozzle 11, thus permitting passage of a rinsing medium and also the passage of drying and compressed air to discharge channels 13. The discharge channels 13 connect with an outlet A of the washing plate 5.

If the titration plate 1 is in the lifted position and pressed against the washing plate 5, in a first operating cycle a rinsing medium, e.g. water, under pressure is supplied through one or several inlets E into feed channels 15 in the washing plate 5 and then through the nozzles 11 under a pressure of up to 4 bars into the cavities 2 of the titration plate. Turbulences occur and the rinsing medium passes through annular gaps 12 into the discharge channels 13.

In order to improve such discharge and to obtain a suction effect, nozzle heads 11′ of the nozzles 11 are of such configuration that their cross-sections decrease in directions from the cavities to channels 13.

Figure 4:
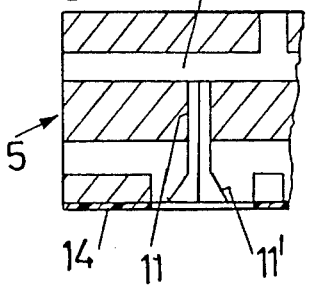
FIGS. 4 to 6 are sections through the washing plate, but showing different shapes of nozzles.
Figure 5:
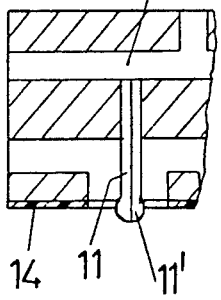
Figure 6:
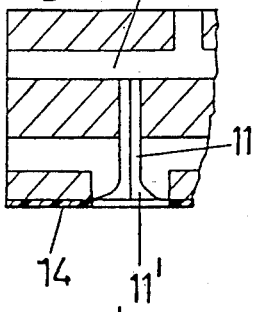

In FIGS. 4 to 6 various embodiments of configurations of the nozzle heads 11′ are shown.

After rinsing, the supply of liquid medium is switched off, and compressed air is injected into the cavities 2 through the same inlets E and feed channels 15 and through the same nozzles 11.

The humidity and temperature of the compressed air is adjustable and controllable. By means of the compressed air, any remaining rinsing liquid is discharged through the annular gaps 12 into the discharge channels 13 and to the outlet A.

The titration plate then can be lowered by means of the support plate 8 and conveyed to the stacking means 4 by means of the toothed belts 7.

It is also possible, however, to lower the titration plate 1 only slightly from the washing plate 5 so that there is only a small gap between the upper face 1′ of the titration plate 1 and a sealing plate 14 of the washing plate 5. If rinsing medium again is passed through the nozzles 11, the sealing plate of the washing plate 5 and the upper face of the titration plate 1 are also cleaned. Such after-rinsing is advantageously carried out before the drying cycle, i.e. before the above-described supply of compressed air. The titration plate 1 then is pressed again against the washing plate 5 by means of the support plate 8, whereupon the compressed air is injected and the titration plate 1 then is dried. In the illustrated embodiment the sealing plate 14 provided at the washing plate 5 is formed of a plastic material.

Figure 8:
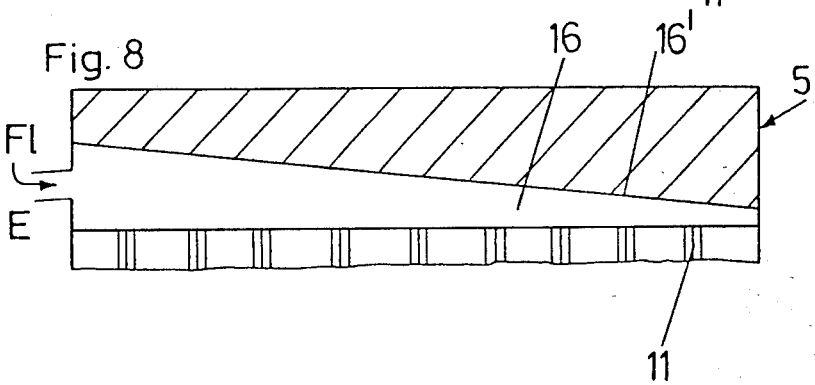
FIG. 8 is a cross-section of a further embodiment of a washing plate.
Figure 9:
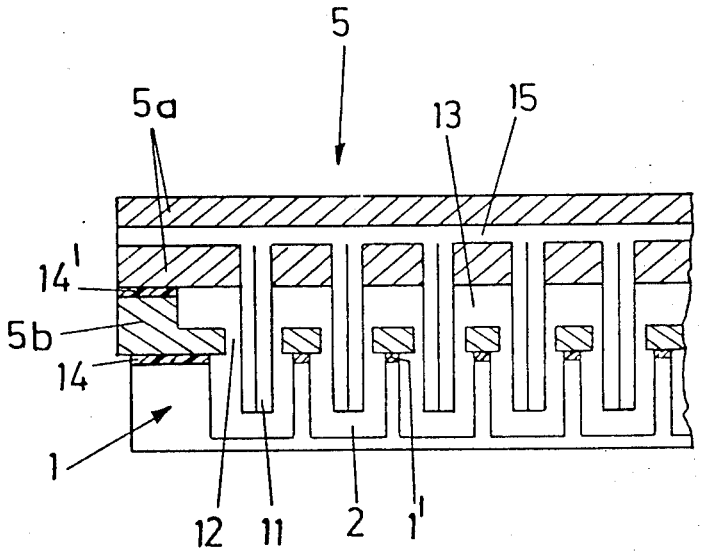
FIG. 9 is a sectional view similar to FIG. 3*a* but of a further embodiment of a washing plate with a titration plate pressed thereto.

In the embodiment according to FIG. 9, the washing plate 5 is divided into a stationary upper part 5*a* provided with the nozzles 11 and a movable lower part 5*b*. In the upper part 5*a* there are provided either a prechamber 16 (FIG. 8) or feed channels 15. The movable lower part 5*b* has bores concentric to the nozzles 11 and forming together with the nozzles 11 the annular gaps 12. When the lower part is pressed against the upper part, the nozzles 11 project through the bores of the lower part 5*b*. Discharge channels 13 are provided in the lower part 5*b*. The sealing plate 14 is positioned between the titration plate 1 and the lower part 5*b*, and a further sealing plate 14′ is provided between the two parts 5*a* and 5*b*.

The nozzles 11 are extended further into cavities 2 than in the afore-described embodiments of FIGS. 3*a* and 4–6, and at the start of the washing operation or immediately prior thereto the lower part 5*b* is lowered to the lower ends of the nozzles 11. When pushed up, the titration plate 1 first presses toward the lower part 5*b* of the washing plate 5, and then the lower part 5*b* together with the titration plate 1 are moved until lower part 5*b* is pressed toward the upper part 5*a*. The nozzles 11 enter the cavities 2 of the titration plate 1 and displace partly the liquid to be discharged therefrom to the discharge channels 13 until the lower part 5*b* is sealingly pressed against the upper part 5*a*. Then, the system is closed and the rinsing operation can start.

The advantages of this embodiment are as follows: The volumes of the concentric bores for defining annular gaps 12 are such that the liquid displaced by the immersion of the nozzles 11 is received in the concentric bores (annular gaps 12) and that contamination accordingly is prevented. Due to the preferably cylindrical shape of nozzle 11 and the immersion thereof into the cavity 2, the volume of the cavity 2 to be rinsed and dried is reduced. The nozzles 11 preferably are immersed into two-thirds of the depth of the cavities 2. The thus resulting increased flow rate increases the cleaning and drying efficiency.

Figure 7:
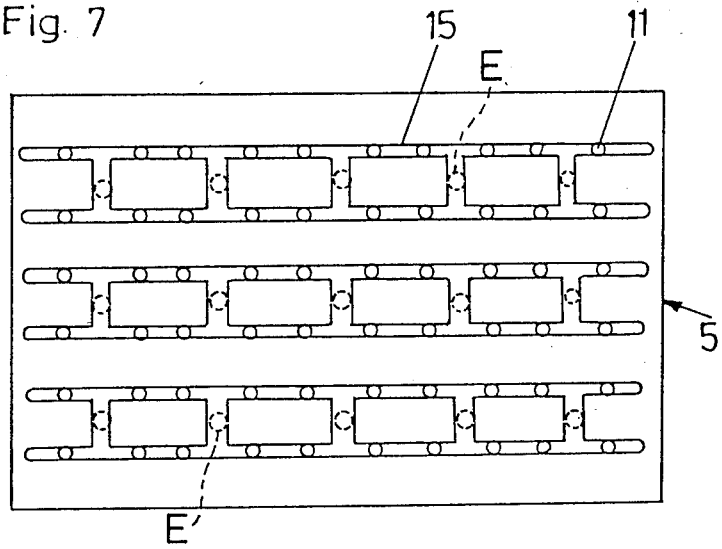
FIG. 7 is a schematic sectional view of a washing plate.

In order to obtain a constant pressure at the nozzles 11, particularly for the rinsing medium, the washing plate 5 can either, as shown in FIG. 7, be provided with H-shaped feed channels 15, in inlets E always being arranged in the center of the connecting bar, or, as shown in FIG. 8, the washing plate 5 can have one or several prechambers 16 which an inclined wall 16', so that the cross-section of the chamber decreases from one row of nozzles to the next row of nozzles, when viewed from the inlet E for the flow F1 of the rinsing medium.

In the automatic washing and rinsing device according to the invention, the connections for air, water and current supply are preferably at the rear side of the device. Further, built-in pressure reducing valves and manometers for controlling the pressure for the rinsing medium and the compressed air are provided. The toothed belt 7 is preferably actuated by a direct-current motor. The washing plate 5 is advantageously exchangeable by means of a quick-release lock. Control of the device may be achieved by means of a microprocessor. The periods for washing, resting and drying cycles can be freely chosen, and the cycles of repetition thereof also may be freely selectable.

Control systems may be provided for operation of the unstacking means, to determine the availability of space in the stacking means, to determine the correct pressure proportions in the device and to determine leakage in the system. Indications thereof may be provided by acoustic signals and/or corresponding LED-indications.

Subsequent washing of the titration plates is effected automatically. After a start command, an input rinsing and drying program is repeated, either until no titration plate 1 remains on the unstacking means 3, or until the program is terminated by a stop button.

We claim:

1. An apparatus for washing and rinsing a titration plate or the like having a plurality of cavities, said apparatus comprising:

a treatment station including means for supporting and retaining in a predetermined orientation a titration plate to be washed and rinsed;

a washing plate having a lower surface and positioned above said supporting means;

means for supplying a titration plate to be washed and rinsed to said supporting means at said treatment station below said washing plate, with the cavities in the titration plate directed upwardly;

means for bringing said lower surface of said washing plate and an upper surface of the titration plate into sealing contact and thereby for sealing the cavities from each other;

said washing plate having at said lower surface thereof a plurality of nozzles equal in number to the number of cavities in the titration plate, such that when said washing plate and the titration plate are in sealing contact each said nozzle is directed into a respective cavity;

said washing plate having formed therein a plurality of bores, each said bore surrounding a respective said nozzle, thereby defining an annular gap between the exterior of each said nozzle and the wall of the respective said bore;

said washing plate having formed therein at least one discharge channel connected with said annular gaps; and means for selectively alternately supplying liquid or gas under pressure through said washing plate and each of said nozzles into the respective cavities and then driving the liquid or gas under pressure through said annular gaps and said discharge channel, thereby selectively cleaning, rinsing or drying the cavities.

2. An apparatus as claimed in claim 1, wherein said liquid or gas supplying means comprises at least one feed channel formed in said washing plate and connected to said nozzles.

3. An apparatus as claimed in claim 1, wherein said supplying means comprises at least one prechamber formed in said washing plate and connected to said nozzles, said prechamber having a cross-section decreasing away from an inlet connected to said washing plate.

4. An apparatus as claimed in claim 1, further comprising a sealing plate between said lower surface of said washing plate and the upper surface of the titration plate, said sealing plate having therethrough openings aligned with said bores.

5. An apparatus as claimed in claim 1, further comprising unstacking means and stacking means located on opposite sides of said treatment station, and said titration plate supplying means comprises conveyor means for transporting one titration plate at a time from said unstacking means to said supporting means and from said supporting means to said stacking means.

6. An apparatus as claimed in claim 3, wherein said conveyor means comprises toothed belts.

7. An apparatus as claimed in claim 1 wherein said bringing means comprises means for raising said supporting means until a titration plate supported thereby is pressed toward said washing plate.

8. An apparatus as claimed in claim 1, wherein said nozzles extend from said lower surface of said washing plate by a distance to extend into respective ones of the cavities.

9. An apparatus as claimed in claim 1, wherein said washing plate comprises a fixed upper portion having extending downwardly therefrom said nozzles, and a movable lower portion having formed therein said bores, said lower portion being movable upwardly into sealing contact with said upper portion, whereat said nozzles extend through respective said bores.

* * * * *